US009150984B2

(12) United States Patent
Custodero et al.

(10) Patent No.: US 9,150,984 B2
(45) **Date of Patent: *Oct. 6, 2015**

(54) METHOD FOR THE PRODUCTION OF A MULTI-LAYER METAL CORD THAT IS RUBBERIZED IN SITU USING AN UNSATURATED THERMOPLASTIC ELASTOMER

(75) Inventors: Emmanuel Custodero, Clermont-Ferrand Cedex 9 (FR); Sébastien Rigo, Clermont-Ferrand Cedex 9 (FR); Jérémy Toussain, Clermont-Ferrand Cedex 9 (FR)

(73) Assignees: COMPAGNIE GENERALE DES ETABLISSEMENTS MICHELIN, Clermont-Ferrand (FR); Michelin Recherche et Technique S.A., Granges-Paccot (CH)

( * ) Notice: Subject to any disclaimer, the term of this patent is extended or adjusted under 35 U.S.C. 154(b) by 164 days.

This patent is subject to a terminal disclaimer.

(21) Appl. No.: 13/699,300

(22) PCT Filed: May 6, 2011

(86) PCT No.: PCT/EP2011/057349

§ 371 (c)(1), (2), (4) Date: May 7, 2013

(87) PCT Pub. No.: WO2011/144473

PCT Pub. Date: Nov. 24, 2011

(65) Prior Publication Data

US 2013/0227924 A1 Sep. 5, 2013

(30) Foreign Application Priority Data

May 20, 2010 (FR) ..... 10 53904

(51) Int. Cl.
*D07B 1/06* (2006.01)
*D02G 3/02* (2006.01)

(Continued)

(52) U.S. Cl.
CPC ..... *D02G 3/02* (2013.01); *D07B 1/062* (2013.01); *D07B 1/0633* (2013.01); *D07B 7/145* (2013.01);

(Continued)

(58) Field of Classification Search
CPC ..... D07B 1/062; D07B 1/0633; D07B 7/145
USPC ..... 57/213, 217, 221, 232, 237, 241, 258
See application file for complete search history.

(56) References Cited

U.S. PATENT DOCUMENTS 4,470,249 A * 9/1984 Chiappetta et al. ..... 57/213
4,487,010 A * 12/1984 Chiappetta et al. ..... 57/213

(Continued)

FOREIGN PATENT DOCUMENTS

EP 1 186 699 3/2002
JP 2002 088668 3/2002

(Continued)

*Primary Examiner* — Shaun R Hurley
(74) *Attorney, Agent, or Firm* — Cozen O'Connor

(57) ABSTRACT

Method of manufacturing a multi-layer metal cord having a plurality of concentric layers of wires, comprising one or more inner layer(s) and an outer layer, of the type "rubberized in situ. The method includes the following steps: at least one step of sheathing at least one inner layer with the rubber or the rubber composition by passing through at least one extrusion head; and an assembling step in which the wires of the outer layer are assembled around the inner layer adjacent to it, in order to form the multi-layer cord thus rubberized from the inside. The rubber is an unsaturated thermoplastic elastomer extruded in the molten state, preferably a thermoplastic elastomer of the thermoplastic stirene (TPS) elastomer type such as an SBS, SBBS, SIS or SBIS block copolymer for example.

10 Claims, 2 Drawing Sheets

(51) Int. Cl.
*D07B 7/14* (2006.01)
*D07B 5/12* (2006.01)

(52) U.S. Cl.
CPC ..... *D07B 1/0646* (2013.01); *D07B 1/0653* (2013.01); *D07B 5/12* (2013.01); *D07B 2201/2028* (2013.01); *D07B 2201/2046* (2013.01); *D07B 2201/2048* (2013.01); *D07B 2201/2059* (2013.01); *D07B 2201/2062* (2013.01); *D07B 2201/2082* (2013.01); *D07B 2205/2003* (2013.01); *D07B 2205/2082* (2013.01); *D07B 2207/205* (2013.01); *D07B 2207/4072* (2013.01); *D07B 2501/2046* (2013.01)

(56) References Cited

U.S. PATENT DOCUMENTS 4,606,183 A * 8/1986 Riggs ..... 57/221
4,667,462 A * 5/1987 Smyth ..... 57/217
6,579,940 B1 6/2003 Dove
8,474,235 B2 * 7/2013 Pottier et al. ..... 57/217
2011/0011486 A1 * 1/2011 Pottier et al. ..... 140/149
2011/0017376 A1 * 1/2011 Pottier et al. ..... 152/451
2011/0198008 A1 * 8/2011 Pottier et al. ..... 152/451
2012/0000174 A1 * 1/2012 Pottier et al. ..... 57/7
2012/0102909 A1 * 5/2012 Pottier et al. ..... 57/17
2012/0110972 A1 * 5/2012 Pottier et al. ..... 57/7
2012/0125512 A1 * 5/2012 Pottier et al. ..... 152/556
2012/0159919 A1 * 6/2012 Gauthier et al. ..... 57/212
2012/0174557 A1 * 7/2012 Boisseau et al. ..... 57/213
2012/0175034 A1 * 7/2012 Gauthier et al. ..... 152/527
2012/0175035 A1 * 7/2012 Toussain et al. ..... 152/527
2012/0186715 A1 * 7/2012 Toussain et al. ..... 152/451
2013/0220505 A1 * 8/2013 Pottier et al. ..... 152/451
2013/0220506 A1 * 8/2013 Pottier et al. ..... 152/451

FOREIGN PATENT DOCUMENTS

WO WO 00/23505 4/2000
WO WO 2005/071157 8/2005
WO WO 2010/105975 9/2010

* cited by examiner

METHOD FOR THE PRODUCTION OF A MULTI-LAYER METAL CORD THAT IS RUBBERIZED IN SITU USING AN UNSATURATED THERMOPLASTIC ELASTOMER

RELATED APPLICATIONS

This is a U.S. National Phase Application under 35 USC 371 of International Application PCT/EP2011/057349 filed on May 6, 2011.

This application claims the priority of French application no. 10/53904 filed May 20, 2010, the entire content of which is hereby incorporated by reference.

FIELD OF THE INVENTION

The present invention relates to methods and devices for the manufacture of multi-layer metallic cords with a plurality of concentric layers of wires that can be used notably for reinforcing articles made of rubber, in particular tires.

It more particularly relates to methods and devices for the manufacture of metallic cords of the type "rubberized in situ", i.e. cords that are rubberized from the inside, during their actual manufacture, with rubber or a rubber composition, with a view to improving their corrosion resistance and consequently their endurance notably in the carcass reinforcements of tires for industrial vehicles.

BACKGROUND OF THE INVENTION

As is known, a radial tire comprises a tread, two inextensible beads, two sidewalls connecting the beads to the tread and a belt positioned circumferentially between the carcass reinforcement and the tread. This carcass reinforcement is made up in the known way of at least one ply (or "layer") of rubber which is reinforced with reinforcing elements ("reinforcers") such as cords or monofilaments, generally of the metallic type in the case of tires for industrial vehicles which bear heavy loads.

To reinforce the above carcass reinforcements, use is generally made of what are known as "layered" steel cords made up of a central layer and of one or more concentric layers of wires positioned around this central layer. By way of example, the three-layered cords most often used are essentially cords of M+N+P construction, formed of a central layer of M wire(s), M varying from 1 to 4, surrounded by an intermediate layer of N wires, N typically varying from 5 to 15, itself surrounded by an outer layer of P wires, P typically varying from 10 to 22, it being possible for the entire assembly to be optionally wrapped with an external wrapping wire wound in a helix around the outer layer.

As is well known, these layered cords are subjected to high stresses when the tires are running along, notably to repeated bendings or variations in curvature which, at the wires, give rise to friction, notably as a result of contact between adjacent layers, and therefore to wear, as well as fatigue; they therefore have to have high resistance to phenomena known as "fatigue-fretting".

It is also particularly important for them to be impregnated as far as possible with the rubber, for this material to penetrate as best as possible into all the spaces between the wires that make up the cords. Indeed, if this penetration is insufficient, empty channels or capillaries are then formed along and within the cords, and corrosive agents, such as water or even the oxygen in the air, liable to penetrate the tires for example as a result of cuts in their tread, travel along these empty channels into the carcass of the tire. The presence of this moisture plays an important role in causing corrosion and accelerating the above degradation processes (the so-called "fatigue-corrosion" phenomena), as compared with use in a dry atmosphere.

All these fatigue phenomena that are generally grouped under the generic term of "fatigue-fretting-corrosion" cause progressive degeneration of the mechanical properties of the cords and may, under the severest running conditions, affect the life of these cords.

To alleviate the above disadvantages, application WO 2005/071157 has proposed three-layered cords of 1+N+P construction, particularly of 1+6+12 construction, one of the essential features of which is that a sheath consisting of a diene rubber composition covers at least the intermediate layer made up of the M wires, it being possible for the core (or individual wire) of the cord itself either to be covered or not to be covered with rubber. Thanks to this special design and to the at least partial filling with rubber of the ensuing capillaries or gaps, not only is excellent rubber penetrability obtained, limiting problems of corrosion, but the fatigue-fretting endurance properties are also notably improved over the cords of the prior art. The longevity of the tires and of their carcass reinforcements are thus very appreciably improved.

However, the described methods for the manufacture of these cords, and the resulting cords themselves, are not free of disadvantages.

First of all, these three-layered cords are obtained in several steps which have the disadvantage of being discontinuous, firstly involving the creation of an intermediate 1+N (particularly 1+6) cord, then sheathing this intermediate cord or core strand using an extrusion head, and finally a final operation of cabling the remaining P wires around the core strand thus sheathed, in order to form the outer layer. In order to avoid the problem of the "raw tack" or parasitic stickiness inherent to the diene rubber sheath in the uncured state, before the outer layer is cabled around the core strand, use must also be made of a plastic interlayer film during the intermediate spooling and unspooling operations. All these successive handling operations are punitive from the industrial standpoint and go counter to achieving high manufacturing rates.

Further, if there is a desire to ensure a high level of penetration of the rubber into the cord in order to obtain the lowest possible air permeability of the cord along its axis, it has been found that it is necessary using these methods of the prior art to use relatively large quantities of rubber during the sheathing operation. Such quantities lead to more or less pronounced unwanted overspill of uncured rubber at the periphery of the as-manufactured finished cord.

Now, as has already been mentioned hereinabove, because of the high tack that diene rubbers have in the uncured state, such unwanted overspill in turn gives rise to appreciable disadvantages during later handling of the cord, particularly during the calendering operations which will follow for incorporating the cord into a strip of diene rubber, likewise in the uncured state, prior to the final operations of manufacture of the tire tread and final curing.

All of the above disadvantages of course slow down the industrial production rates and have an adverse effect on the final cost of the cords and of the tires they reinforce.

SUMMARY OF THE INVENTION

One object of the invention is to provide an improved method of manufacture, using a specific type of rubber, which is able to alleviate the abovementioned disadvantages.

Accordingly, one aspect of the invention relates to a method of manufacturing a multi-layer metal cord having a plurality of concentric layers of wires, comprising one or more inner layer(s) and an outer layer, of the type "rubberized in situ", i.e. rubberized from the inside, during its actual manufacture, with rubber or a rubber composition, the said method including at least the following steps:

at least one step of sheathing at least one inner layer with the said rubber or the said rubber composition by passing through at least one extrusion head;

an assembling step in which the wires of the outer layer are assembled around the inner layer adjacent to it, in order to form the multi-layer cord thus rubberized from the inside, and is characterized in that the said rubber is an unsaturated thermoplastic elastomer extruded in the molten state.

This method makes it possible to manufacture, in line and continuously, a multi-layer cord with a plurality of concentric layers which, when compared with the multi-layer cords rubberized in situ of the prior art, has the notable advantage that the rubber used as filling rubber is an elastomer of the thermoplastic type rather than of the diene type, which by definition is a hot melt elastomer and therefore easier to use, the quantity of which can easily be controlled; it is thus possible, by altering the temperature at which the thermoplastic elastomer is used, to distribute the latter uniformly within each of the gaps in the cord, giving the latter optimal impermeability along its longitudinal axis.

Further, the above thermoplastic elastomer presents no problems of unwanted tackiness in the event of a slight overspill out of the cord after manufacture thereof. Finally, the unsaturated and therefore (co)vulcanizable nature of this unsaturated thermoplastic elastomer offers the cord excellent compatibility with the unsaturated diene rubber matrices such as natural rubber matrices conventionally used as calendering rubber in the metallic fabrics intended for reinforcing tires.

I. DETAILED DESCRIPTION OF THE DRAWINGS

Figure 1:
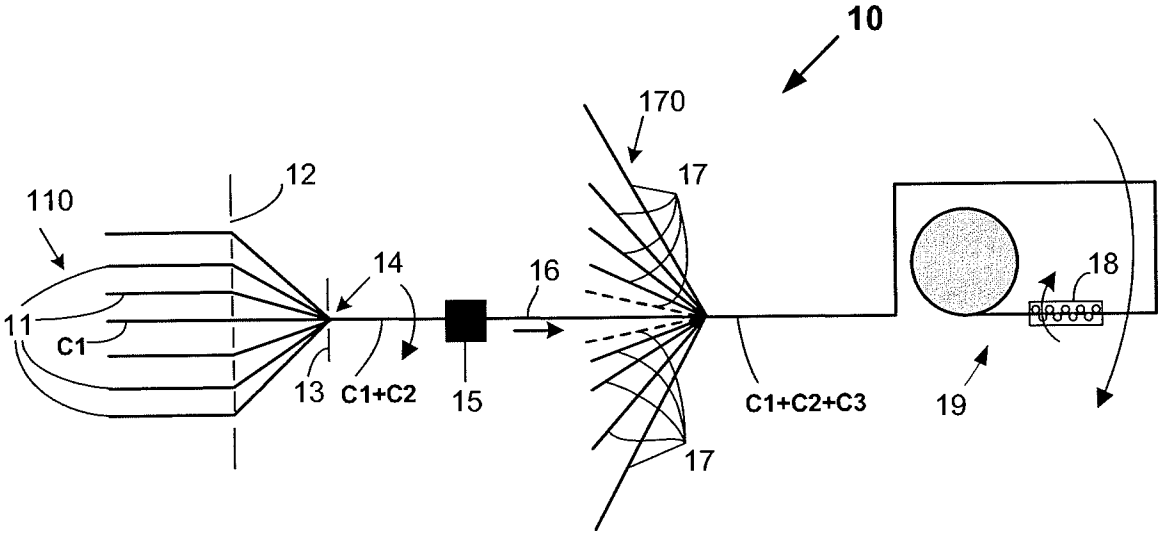
FIG. 1 shows an example of an in situ rubberizing and twisting device that can be used for manufacturing a three-layered cord according to a method in accordance with an embodiment of the invention.

In the present description, unless expressly indicated otherwise, all the percentages (%) indicated are % by weight.

Moreover, any range of values denoted by the expression "between a and b" represents the range of values extending from more than a to less than b (i.e. excluding the end points a and b) whereas any range of values denoted by the expression "from a to b" means the range of values extending from a up to b (i.e. including the strict end points a and b).

The method of the invention is therefore intended for the manufacture of a multi-layer metal cord having a plurality of concentric layers of wires, comprising one or more inner layer(s) and an outer layer, of the type "rubberized in situ", i.e. rubberized from the inside, during its actual manufacture, with rubber or a rubber composition (known as "filling rubber"), the said method including at least the following steps:

at least one step of sheathing at least one inner layer with the said rubber or the said rubber composition by passing through at least one extrusion head;

an assembling step in which the wires of the outer layer are assembled around the inner layer adjacent to it, in order to form the multi-layer cord thus rubberized from the inside, and is characterized in that the said rubber is an unsaturated thermoplastic elastomer extruded in the molten state.

When the inner layer(s) comprise a plurality of wires, it must be understood that the method of the invention involves a prior assembling step (whatever the direction, S or Z) of assembling the wire(s) of the said inner layer(s).

In the method of the invention, the so-called filling rubber is therefore introduced in situ into the cord while it is being manufactured, by sheathing at least one inner layer, for example either the innermost layer or core of the cord, or another inner layer, or even each inner layer when the cord comprises at least two distinct inner layers, the said sheathing itself being performed in the known way for example by passage through at least one (i.e. one or more) extrusion head(s) that deliver the filling rubber in the molten state.

It will be recalled here that there are two possible techniques for assembling metal wires:

either by cabling: in which case the wires undergo no twisting about their own axis, because of a synchronous rotation before and after the assembling point;

or by twisting: in which case the wires undergo both a collective twist and an individual twist about their own axis, thereby generating an untwisting torque on each of the wires and on the cord itself.

Both of the above techniques are applicable, although use is preferably made of a twisting step for each of the above assembling steps.

According to another preferred embodiment, when at least one (i.e. one or more) inner layer comprises a plurality of wires, each step of assembling the wires of the outer layer on the one hand, and each inner layer containing more than one wire on the other hand, is performed by twisting.

According to another preferred embodiment, when at least one (i.e. one or more) inner layer contains more than one wire, the wires of the outer layer are wound in a helix with the same pitch and in the same direction of winding as the wires of each inner layer containing more than one wire, in order to obtain a compact cord.

The or each extrusion head is raised to a suitable temperature, easily adjustable to suit the specific nature of the TPE used and its thermal properties. For preference, the extrusion temperature for the unsaturated TPE is comprised between 100° C. and 250° C., more preferably between 150° C. and 200° C. Typically, the extrusion head defines a sheathing zone which, for example, has the shape of a cylinder of revolution the diameter of which is preferably comprised between 0.15 mm and 1.2 mm, more preferably between 0.20 and 1.0 mm and the length of which is preferably comprised between 1 and 10 mm.

The amount of filling rubber delivered by the extrusion head is adjusted within a preferred range comprised between 5 and 40 mg per gram of finished (i.e. as-manufactured, rubberized in situ) cord. Below the indicated minimum it is more difficult to guarantee that the filling rubber will be present, at least in part, in each of the gaps or capillaries of the cord, whereas above the indicated maximum, the cord is exposed to a risk of excessive overspill of the filling rubber at the periphery of the cord. For all of these reasons, it is preferable for the filling rubber content to be comprised between 5 and 35 mg, notably between 5 and 30 mg, more particularly in a range from 10 to 25 mg per gram of cord.

The unsaturated thermoplastic elastomer in the molten state thus covers the inner layer(s) via the sheathing head, at a rate of progress typically of a few meters to a few tens of m/min, for an extrusion pump flow rate typically of several $cm^3$/min to several tens of $cm^3$/min. The wires of the inner layer(s), as appropriate, are advantageously preheated before passing through the extrusion head, for example by passing through an HF generator or through a heating tunnel.

When the multi-layer cord according to the invention is a two-layer cord, and therefore comprises one single inner layer, sheathing is of course performed on the core alone. In such instances, the core, once sheathed, is covered with a minimum thickness of unsaturated TPE that is preferably greater than 5 μm, and typically comprised between 5 and 30 μm.

When the cord comprises several (at least two) inner layers, sheathing is performed either on the core alone, or on another inner layer, or even on each inner layer. In instances where only the core is sheathed, the core once sheathed is covered with a minimum thickness of unsaturated TPE that is preferably greater than 20 μm, and typically comprised between 20 and 100 μm, in an amount sufficient for subsequently being able to coat the wires of the other inner layer or even layers once this or these have been laid. In instances where another inner layer or even each inner layer is or are sheathed, the outermost inner layer, which means the one adjacent to the outer layer, is covered with a minimum thickness of unsaturated TPE that is preferably greater than 5 μm, and typically comprised between 5 and 30 μm.

Then the wires of the outer layer are cabled or twisted together (S direction or Z direction) around the inner layer adjacent to them in order to form the multi-layer cord thus rubberized from the inside. During this final assembly, the wires of the outer layer come to press against the filling rubber in the molten state and become embedded therein. The filling rubber, as it is displaced under the pressure applied by these outer wires, then has a natural tendency to penetrate each of the gaps or cavities left empty by the wires, between the outer layer and the inner layer adjacent to it.

For preference, all the steps of the method of the invention are performed in line and continuously, whatever the type of cord manufactured (compact cord just like cylindrical layered cord), and all at high speed. The above method can be carried out at a speed (rate of travel of the cord down the production line) in excess of 50 m/min, preferably in excess of 70 m/min, notably in excess of 100 m/min.

However, it is of course also possible to manufacture the cord according to the invention discontinuously, for example, in the case of a preferred 3-layered cord, by first of all sheathing the core strand (C1+C2), solidifying the filling rubber, then spooling and storing this strand prior to the final operation of assembling the third and final layer (C3); solidifying the elastomer sheath is easy; it can be performed by any appropriate cooling means, for example by air cooling or water cooling, followed in the latter instance by a drying operation.

At this stage, the manufacture of the cord according to the invention is complete. However when, according to a preferred embodiment of the invention, the various layers of the cord are assembled by twisting, it is then preferable to add a twist balancing step in order to obtain a cord that is said to be twist balanced (or stabilized); "twist balancing" here in the known way means the cancelling out of residual twisting torques (or untwisting spring-back) exerted on the cord. The twist balancing tools are well known to those skilled in the art of twisting; they may for example consist of straighteners and/or of twisters and/or of twister-straighteners consisting either of pulleys in the case of twisters or of small-diameter rollers in the case of straighteners, through which pulleys and/or rollers the cord runs.

For preference, in this completed cord, the thickness of filling rubber between two adjacent wires of the cord, whichever they may be, varies from 1 to 10 μm. This cord can be wound onto a receiving spool, for storage, before for example being treated via a calendering installation, in order to prepare a metal/diene rubber composite fabric that can be used for example as a tire carcass reinforcement or alternatively as a tire crown reinforcement.

The multi-layer metallic cord obtained according to the method of the invention can be termed an in-situ rubberized cord, i.e. it is rubberized from the inside, during its actual manufacture, with rubber or a rubber composition known as filling rubber.

In other words, in the as-manufactured state, most or preferably all of its "capillaries" or "gaps" (the two terms, which are interchangeable, denoting the free empty spaces formed by adjacent wires in the absence of filling rubber) already contain a special rubber by way of filling rubber which at least partially fills the said gaps, continuously or discontinuously along the axis of the cord. What is meant as the as-manufactured cord is of course a cord which has not yet been brought into contact with a diene rubber (e.g. natural rubber) matrix of a semi-finished product or a finished article made of rubber such as a tire, that the said cord would be subsequently intended to reinforce.

This special rubber is an unsaturated thermoplastic elastomer, used alone or with possible additives (i.e. in this case in the form of an unsaturated thermoplastic elastomer composition) to constitute the filling rubber.

It will be recalled first of all here that thermoplastic elastomers ("TPE" for short) are thermoplastic elastomers in the form of block copolymers based on thermoplastic blocks. Having a structure that is somewhere between that of a thermoplastic polymer and that of an elastomer, they are made up in the known way of rigid thermoplastic, notably polystirene, sequences connected by flexible elastomer sequences, for example polybutadiene or polyisoprene sequences in the case of unsaturated TPEs or poly(ethylene/butylene) sequences in the case of saturated TPEs.

This is why, in the known way, the above TPE block copolymers are generally characterized by the presence of two glass transition peaks, the first peak (the lower, generally negative, temperature) relating to the elastomer sequence of the TPE copolymer and the second peak (the positive, higher, temperature typically above 80° C. for preferred elastomers of the TPS type) relating to the thermoplastic (for example stirene block) part of the TPE copolymer.

These TPEs are often three-block elastomers with two rigid segments connected by one flexible segment. The rigid and flexible segments can be arranged linearly, or in a star or branched configuration. These TPEs may also be two-block elastomers with one single rigid segment connected to a flexible segment. Typically, each of these blocks or segments contains at minimum more than 5, generally more than 10 base units (for example stirene units and isoprene units in the case of a stirene/isoprene/stirene block copolymer).

That reminder having been given, one essential feature of the TPE used in the method of the invention is that it is unsaturated. An unsaturated TPE by definition and as is well known means a TPE that has ethylene unsaturations, i.e. that contains (conjugated or unconjugated) carbon-carbon double bonds; conversely, a TPE said to be saturated is of course a TPE that has no such double bonds.

The unsaturated nature of the unsaturated TPE means that the latter is (co)crosslinkable, (co)vulcanizable with sulphur, making it advantageously compatible with the unsaturated diene rubber matrices such as those based on natural rubber which are habitually used as calendering rubber in the metallic fabrics intended for reinforcing tires. Thus, any overspill of the filling rubber out of the cord, during the manufacture thereof, will not be detrimental to its subsequent adhesion to the calendering rubber of the said metallic fabric, as this defect can in fact be corrected during final curing of the tire by the possibility of co-crosslinking between the unsaturated TPE and the diene elastomer of the calendering rubber.

For preference, the unsaturated TPE is a thermoplastic stirene ("TPS" for short) elastomer, i.e. one which, by way of thermoplastic blocks, comprises stirene (polystirene) blocks.

More preferably, the unsaturated TPS elastomer is a copolymer comprising polystirene blocks (i.e. blocks formed of polymerized stirene monomer) and polydiene blocks (i.e. blocks formed of polymerized diene monomer), preferably of the latter polyisoprene blocks and/or polybutadiene blocks.

Polydiene blocks, notably polyisoprene and polydiene blocks, also by extension in this application means statistical diene copolymer blocks, notably of isoprene or of butadiene, such as statistical stirene/isoprene (SI) or stirene-butadiene (SB) copolymer blocks, these polydiene blocks being particularly associated with polystirene thermoplastic blocks to constitute the unsaturated TPS elastomers described hereinabove.

A stirene monomer is to be understood to mean any monomer based on stirene, unsubstituted or substituted; examples of substituted stirenes may include methylstirenes (for example o-methylstirene, m-methylstirene or p-methylstirene, alpha-methylstirene, alpha-2-dimethylstirene, alpha-4-dimethylstirene or diphenylethylene), para-tert-butylstirene, chlorostirenes (for example o-chlorostirene, m-chlorostirene, p-chlorostirene, 2,4-dichlorostirene, 2,6-dichlorostirene or 2,4,6-trichlorostirene), bromostirenes (for example o-bromostirene, m-bromostirene, p-bromostirene, 2,4-dibromostirene, 2,6-dibromostirene or 2,4,6-tribromostirene), fluorostirenes (for example o-fluorostirene, m-fluorostirene, p-fluorostirene, 2,4-difluorostirene, 2,6-difluorostirene or 2,4,6-trifluorostirenes), para-hydroxy-stirene and blends of such monomers.

A diene monomer is to be understood to mean any monomer bearing two conjugated or unconjugated carbon-carbon double bonds, particularly any conjugated diene monomer having 4 to 12 carbon atoms selected notably from the group consisting of isoprene, butadiene, 1-methylbutadiene, 2-methylbutadiene, 2,3-dimethyl-1,3-butadiene, 2,4-dimethyl-1,3-butadiene, 1,3-pentadiene, 2-methyl-1,3-pentadiene, 3-methyl-1,3-pentadiene, 4-methyl-1,3-pentadiene, 2,3-dimethyl-1,3-pentadiene, 2,5-dimethyl-1,3-pentadiene, 1,3-hexadiene, 2-methyl-1,3-hexadiene, 3-methyl-1,3-hexadiene, 4-methyl-1,3-hexadiene, 5-methyl-1,3-hexadiene, 2,5-dimethyl-1,3-hexadiene, 2-neopentylbutadiene, 1,3-cyclopentadiene, 1,3-cyclohexadiene, 1-vinyl-1,3-cyclohexadiene and blends of such monomers.

Such an unsaturated TPS elastomer is selected in particular from the group consisting of stirene/butadiene (SB), stirene/isoprene (SI), stirene/butadiene/butylene (SBB), stirene/butadiene/isoprene (SBI), stirene/butadiene/stirene (SBS), stirene/butadiene/butylene/stirene (SBBS), stirene/isoprene/stirene (SIS) and stirene/butadiene/isoprene/stirene (SBIS) block copolymers and blends of these copolymers.

More preferably still, this unsaturated TPS elastomer is a copolymer containing at least three blocks, this copolymer being more particularly selected from the group consisting of stirene/butadiene/stirene (SBS), stirene/butadiene/butylene/stirene (SBBS), stirene/isoprene/stirene (SIS) and stirene/butadiene/isoprene/stirene (SBIS) block copolymers and blends of these copolymers.

According to a particular and preferred embodiment of the invention, the stirene content in the above unsaturated TPS elastomer is comprised between 5 and 50%. Below 5%, there is a risk that the thermoplastic nature of the TPS elastomer will be insufficient whereas above 50% there is a risk firstly of excessive rigidification of this elastomer and secondly of a reduction in its ability to be (co)crosslinked.

According to another particular and preferred embodiment of the invention, the number-average molecular weight (denoted Mn) of the TPE (notably TPS elastomer) is preferably comprised between 5000 and 500 000 g/mol, more preferably comprised between 7000 and 450 000. The number-average molecular weight (Mn) of the TPS elastomers is determined in the known way, by steric exclusion chromatography (SEC). The specimen is dissolved beforehand in tetrahydrofuran at a concentration of around 1 g/l then the solution is filtered on a filter of porosity 0.45 μm prior to injection. The apparatus used is a "WATERS alliance" chromatography set. The elution solvent is tetrahydrofuran, the flow rate 0.7 ml/min, the system temperature 35° C. and the analysis duration 90 min. Use is made of a set of four WATERS columns in series, with the trade names "STYRAGEL" ("HMW7", "HMW6E" and two lots of "HT6E"). The injected volume of the solution of the polymer specimen is 100 μl. The detector is a "WATERS 2410" differential refractometer and its associated chromatography data processing software is the "WATERS MILLENIUM" system. The calculated average molecular weights relate to a calibration curve produced using polystirene test standards.

According to another particular and preferred embodiment of the invention, the Tg of the unsaturated TPE (notably TPS elastomer) (remember, the first Tg relating to the elastomer sequence) is below 0° C., more particularly below −15° C., this parameter being measured in the known way by DSC (Differential Scanning calorimetry), for example in accordance with Standard ASTM D3418-82.

According to another particular and preferred embodiment of the invention, the Shore A hardness (measured in accordance with ASTM D2240-86) of the unsaturated TPE (notably TPS elastomer) is comprised between 10 and 100, more particularly comprised in a range from 20 to 90.

Unsaturated TPS elastomers such as, for example, SB, SI, SBS, SIS, SBBS or SBIS are well known and commercially available, for example from the company Kraton under the trade name "Kraton D" (e.g. products D1161, D1118, D1116, D1163), from the company Dynasol under the trade name "Calprene" (e.g. products C405, C411, C412), from the company Polimeri Europa under the trade name "Europrene" (e.g. product SOLT166), from the company BASF under the trade name "Styroflex" (e.g. product 2G66) or alternatively from the company Asahi under the trade name "Tuftec" (e.g. product P1500).

The unsaturated thermoplastic elastomer described above is sufficient on its own for the filling rubber to fully perform its function of plugging the capillaries or gaps of the cord according to the invention. However, various other additives may be added, typically in small quantities (preferably at parts by weight of less than 20 parts, more preferably of less than 10 parts per 100 parts of rubber with respect to the unsaturated thermoplastic elastomer), these for example including plasticizers, reinforcing fillers such as carbon black or silica, non-reinforcing or inert fillers, lamellar fillers, protective agents such as antioxidants or antiozone agents, various other stabilizers, colorants intended for example to colour the filling rubber. The filling rubber could also contain, in a minority fraction by weight with respect to the fraction of unsaturated thermoplastic elastomer, polymers or elastomers other than unsaturated thermoplastic elastomers.

According to another particularly preferred embodiment of the invention, over any portion of cord of length equal to 2 cm, each gap or capillary of the cord comprises at least one plug of rubber which blocks this capillary or gap in such a way that, in the air permeability test in accordance with paragraph I-2, this cord has a mean air flow rate of less than 2 $cm^3$/min, more preferably less than 0.2 $cm^3$/min, or at most equal to 0.2 $cm^3$/min.

According to another particularly preferred embodiment, the filling rubber content in the cord is comprised between 5 and 40 mg of rubber per g of cord. Below the indicated minimum it is more difficult to guarantee that the filling rubber will be present, at least in part, in each of the gaps or capillaries of the cord, whereas above the indicated maximum, the cord is exposed to a risk of overspill of the filling rubber at the periphery of the cord. For all of these reasons, it is preferable for the filling rubber content to be comprised between 5 and 35 mg, notably between 5 and 30 mg, more particularly in a range from 10 to 25 mg per g of cord.

The term "metal cord" is understood by definition in the present application to mean a cord formed from wires consisting predominantly (i.e. more than 50% by number of these wires) or entirely (100% of the wires) of a metallic material.

Independently of one another and from one layer to another, the wire or wires of the core (C1), the wires of the second layer (C2) and the wires of the third layer (C3) are preferably made of steel, more preferably of carbon steel. However, it is of course possible to use other steels, for example a stainless steel, or other alloys.

When a carbon steel is used, its carbon content (% by weight of steel) is preferably comprised between 0.2% and 1.2%, notably between 0.5% and 1.1%; these contents represent a good compromise between the mechanical properties required for the tire and the feasibility of the wires. It should be noted that a carbon content comprised between 0.5% and 0.6% ultimately makes such steels less expensive because they are easier to draw. Another advantageous embodiment of the invention may also consist, depending on the intended applications, in using steels with a low carbon content, comprised for example between 0.2% and 0.5%, particularly because of a lower cost and greater drawability.

The metal or the steel used, whether in particular it is a carbon steel or a stainless steel, may itself be coated with a metal layer which, for example, improves the workability of the metal cord and/or of its constituent elements, or the use properties of the cord and/or of the tire themselves, such as properties of adhesion, corrosion resistance or resistance to ageing. According to one preferred embodiment, the steel used is covered with a layer of brass (Zn—Cu alloy) or of zinc; it will be recalled that, during the wire manufacturing process, the brass or zinc coating makes the wire easier to draw, and makes the wire adhere to the rubber better. However, the wires could be covered by a thin layer of metal other than brass or zinc, having, for example, the function of improving the corrosion resistance of these wires and/or their adhesion to the rubber, for example a thin layer of Co, Ni, Al, an alloy of two or more of the compounds Cu, Zn, Al, Ni, Co, Sn.

The cords obtained according to the method of the invention are preferably made of carbon steel and have a tensile strength (Rm) preferably higher than 2500 MPa, more preferably higher than 3000 MPa. The total elongation at break (At) of the cord, which is the sum of its structural, elastic and plastic elongations, is preferably greater than 2.0%, more preferably at least equal to 2.5%.

By way of example, to illustrate the implementation of the invention in greater detail in the case of a preferred cord with three layers (C1, C2, C3) of M+N+P construction, comprising a first layer or core (C1) of diameter $d_c$ made up of M wire(s) of diameter $d_1$, around which core are wound together as a helix at a pitch $p_2$, as a second layer (C2), N wires of diameter $d_2$, around which second layer are wound together as a helix at a pitch $p_3$, as a third layer (C3), P wires of diameter $d_3$, the method of the invention thus comprises at least the following steps:

firstly, a step of assembling the N wires of the second layer (C2), around the core (C1) in order to form, at a point called the "assembling point", an intermediate cord called "core strand" of M+N (or C1+C2) construction;

respectively upstream and/or downstream of the said assembling point, a step of sheathing the core and/or the core strand with a special rubber (or rubber composition) (called "filling rubber") which is extruded in the molten state by passage through one or more extrusion head(s);

then a step of assembling the P wires of the third layer (C3) around the core strand (M+N) to form the cord of M+N+P construction thus rubberized from the inside.

The innermost layer or central layer (C1) is also known as the "core" of the cord, whereas the first (C1) and the second (C2) layers once assembled (C1+C2) constitute what is customarily known as the core strand of the cord. When the core (C1) consists of a plurality of wires, the diameter $d_c$ of the core (C1) then represents the diameter of the imaginary cylinder of revolution (or envelope diameter) surrounding the M central wires of diameter $d_1$.

In this preferred case of a 3-layered cord, according to a first possible embodiment, sheathing is performed on the core (C1) alone, i.e. upstream of the assembling point of the N wires of the second layer (C2) around the core. Then the N wires of the second layer (C2) are cabled or twisted together (S direction or Z direction) around the core (C1) to form the core strand (C1+C2), in the way known per se; the wires are delivered by feed means such as spools, a distributing grid, which may or may not be coupled to an assembling guide, which are intended to cause the N wires to converge around the core at a common twisting point (or assembling point).

According to another possible embodiment, still in this preferred case of a 3-layered cord, sheathing is performed on the core strand (C1+C2) itself, i.e. downstream (rather than upstream) of the assembling point of the N wires of the second layer (C2) around the core.

Then, during the course of a new step, still in this preferred case of a three-layered cord, final assembly is performed by cabling or twisting (S direction or Z direction) the P wires of the third layer or outer layer (C3) around the core strand (M+N or C1+C2).

Thus, in both of the above preferred cases of in-situ rubberization of a 3-layered cord (sheathing either of the core or of the core strand), the filling rubber can be delivered at a single, small-sized, fixed point by means of a single extrusion head; however, the in-situ rubberizing could also be performed in two successive sheathing operations, a first sheathing operation on the core (therefore upstream of the assembling point) and a second sheathing operation on the core strand (therefore downstream of the assembling point).

According to another preferred embodiment, the core or central layer (C1) of diameter $d_c$ is made up of 1 to 4 wires of diameter $d_1$ (i.e. M is comprised in a range from 1 to 4), N is comprised in a range from 5 to 15, and P is comprised in a range from 10 to 22. More preferably still, M is equal to 1, N is comprised in a range from 5 to 7, and P is comprised in a range from 10 to 14.

When the core (C1) consists of a single wire (M equal to 1), the diameter $d_1$ of the core wire is then preferably comprised in a range from 0.08 to 0.40 mm.

According to another preferred embodiment, the following characteristics are satisfied ($d_1$, $d_2$, $d_3$, $p_2$ and $p_3$ being expressed in mm):

$$0.08 \le d_1 \le 0.40;$$

$$0.08 \le d_2 \le 0.35;$$

$$0.08 \le d_3 \le 0.35;$$

$$5\pi(d_1+d_2) < p_2 \le p_3 < 10\pi(d_1+2d_2+d_3).$$

The core (C1) of the cord is preferably made up of a single individual wire or at most of 2 or 3 wires, it being possible for example for these to be parallel or even twisted together.

However, for greater preference, the core (C1) of the cord is made up of a single wire, N is comprised in a range from 5 to 7, and P is comprised in a range from 10 to 14.

It will be recalled here that, as is known, the pitch "p" represents the length, measured parallel to the axis of the cord, after which a wire that has this pitch has made a complete turn around the said axis of the cord.

For an optimized compromise between strength, feasibility, rigidity and flexural endurance of the cord, it is preferable for the diameters of the wires of the layers C1, C2 and C3, whether or not these wires have the same diameter from one layer to another, to satisfy the following relationships ($d_1$, $d_2$, $d_3$ being expressed in mm):

$$0.10 \le d_1 \le 0.35;$$

$$0.10 \le d_2 \le 0.30;$$

$$0.10 \le d_3 \le 0.30.$$

More preferably still, the following relationships are satisfied:

$$0.10 \le d_1 \le 0.28;$$

$$0.10 \le d_2 \le 0.25;$$

$$0.10 \le d_3 \le 0.25.$$

According to another particular embodiment, the following features are satisfied:

$$\text{for } N=5:\ 0.6 < (d_1/d_2) < 0.9;$$

$$\text{for } N=6:\ 0.9 < (d_1/d_2) < 1.3;$$

$$\text{for } N=7:\ 1.3 < (d_1/d_2) < 1.6.$$

The wires of the layers C2 and C3 may have a diameter that is the same or different from one layer to the other; use is preferably made of wires of the same diameter from one layer to the other (i.e. $d_2=d_3$) as this notably simplifies manufacture and reduces the cost of the cords.

For preference, the following relationship is satisfied:

$$5\pi(d_1+d_2) < p_2 \le p_3 < 5\pi(d_1+2d_2+d_3).$$

The pitches $p_2$ and $p_3$ are more preferably chosen in a range from 5 to 30 mm, more preferably still in a range from 5 to 20 mm, particularly when $d_2=d_3$.

According to a preferred embodiment the diameter $d_2$ is comprised in a range from 0.08 to 0.35 mm and the twisting pitch $p_2$ is comprised in a range from 5 to 30 mm.

According to another preferred embodiment the diameter d3 is comprised in a range from 0.08 to 0.35 mm and the twisting pitch $p_3$ is greater than or equal to $p_2$.

According to another preferred embodiment, $p_2$ and $p_3$ are equal. This is notably the case of layered cords of the compact type like those depicted schematically for example in FIG. 2, in which the two layers C2 and C3 have the further feature of being wound in the same direction of twisting (S/S or Z/Z). In such "compact" layered cords, the compactness is very high such that the cross section of these cords has a contour which is polygonal rather than cylindrical, as illustrated by way of example in FIG. 2 (compact 1+6+12 cord according to the invention) or in FIG. 3 (control compact 1+6+12 cord, namely one that has not been rubberized in situ).

When the core (C1) is made up of more than one wire (M other than 1), the M wires are preferably assembled, notably twisted, at a pitch $p_1$ which is more preferably comprised in a range from 3 to 30 mm, particularly in a range from 3 to 20 mm.

The third layer or outer layer C3 has the preferred feature of being a saturated layer, i.e. by definition, there is not enough space in this layer for at least one $(P_{max}+1)^{th}$ wire of diameter $d_3$ to be added to it, $P_{max}$ representing the maximum number of wires that can be wound in a layer around the second layer C2. This construction has the notable advantage of further limiting the risk of overspill of filling rubber at its periphery and, for a given cord diameter, of offering greater strength.

Thus, the number P of wires can vary to a very large extent according to the particular embodiment of the invention, it being understood that the maximum number of wires P will be increased if their diameter $d_3$ is reduced by comparison with the diameter $d_2$ of the wires of the second layer, in order preferably to keep the outer layer in a saturated state.

According to a particularly preferred embodiment, the first layer (C1) comprises a single wire (M equal to 1), the second layer (C2) comprises 6 wires (N equal to 6) and the third layer (C3) comprises 11 or 12 wires (P equal to 11 or 12); in other words, the cord according to the invention has the preferential construction 1+6+11 or 1+6+12. Of these cords, those more particularly preferred are those made up of wires having substantially the same diameter from the second layer (C2) to the third layer (C3) (namely $d_2=d_3$).

The cord prepared according to the invention, like all layered cords, may be of two types, namely of the type with compact layers or of the type with cylindrical layers.

For preference, the wires of the outer layer, are wound as a helix in the same direction of twisting, i.e. either in the S direction ("S/S" arrangement), or in the Z direction ("Z/Z" arrangement) as the wires of the inner layer(s) containing more than one wire, in order to obtain a compact cord. Winding these layers in the same direction advantageously minimizes friction between these two layers and therefore wear on the wires of which they are composed. More preferably, all of these layers are wound in the same direction of twisting and at the same helix pitch in order to obtain a cord of compact type as depicted for example in FIG. 2.

The method of the invention makes it possible to manufacture cords which, according to one particularly preferred embodiment, may have no, or virtually no, filling rubber at their periphery; what is meant by that is that no particle of filling rubber is visible, to the naked eye, on the periphery of the cord, that is to say that a person skilled in the art would, after manufacture, see no difference, to the naked eye, from a distance of three meters or more, between a spool of cord prepared according to the invention and a spool of conventional cord that has not been rubberized in situ.

However, as indicated previously, any possible overspill of filling rubber at the periphery of the cord will not be detrimental to its later adhesion to a metal fabric calendering rubber, thanks to the co-crosslinkable nature of the unsaturated thermoplastic elastomer and of the diene elastomer of the said calendering rubber.

The method of the invention of course applies to the manufacture of cords of the compact type (remember and by definition that these are cords in which the layers are wound at the same pitch and in the same direction) just as it does to the manufacture of cords of the type with cylindrical layers (remember and by definition that these are cords in which the layers are wound either at different pitches (whatever their directions of twisting, identical or otherwise) or in opposite directions (whatever their pitches, identical or different).

An assembly and rubberizing device that can be used for implementing the above-mentioned method of the invention and applied by way of example to the manufacture of a 3-layered cord is a device comprising, from upstream to downstream in the direction of travel of a cord as it is being formed:

- feed means for, on the one hand, feeding the wire or M wires of the first layer or core (C1) and, on the other hand, feeding the N wires of the second layer (C2);
- first assembling means for assembling the N wires for applying the second layer (C2) around the first layer (C1) at a point called the "assembling point", to form an intermediate cord called a "core strand" of M+N construction;
- second assembling means for assembling the P wires around the core strand thus sheathed, in order to apply the third layer (C3);
- extrusion means delivering the thermoplastic elastomer in the molten state and which are respectively arranged upstream and/or downstream of the first assembling means, in order to sheath the core and/or the M+N core strand.

Of course, when M is greater than 1, the above device also comprises assembling means for assembling the M wires of the central layer (C1) which are arranged between the feed means for these M wires and the assembling means for the N wires of the second layer (C2). In the event of double sheathing (core and core strand), the extrusion means are therefore positioned both upstream and downstream of the first assembling means.

The attached FIG. 1 shows an example of a twisting assembling device (10), of the type having a fixed feed and a rotary receiver, that can be used for the manufacture of a cord of the compact type ($p_2=p_3$ and same direction of twisting of the layers C2 and C3). In this device (10), feed means (110) deliver, around a single core wire (C1), N wires (11) through a distributing grid (12) (an axisymmetric distributor), which may or may not be coupled to an assembling guide (13), beyond which grid the N (for example 6) wires of the second layer converge on an assembling point (14) in order to form the core strand (C1+C2) of 1+N (for example 1+6) construction.

The core strand (C1+C2), once formed, then passes through a sheathing zone consisting, for example, of a single extrusion head (15) consisting of a twin-screw extruder (fed from a hopper containing the TPE in granule form) feeding a sizing die via a pump. The distance between the point of convergence (14) and the sheathing point (15) is for example comprised between 50 cm and 1 m. The P wires (17) of the outer layer (C3), of which there are for example twelve, delivered by feed means (170) are then assembled by twisting around the core strand thus rubberized (16) progressing in the direction of the arrow. The final (C1+C2+C3) cord thus formed is finally collected on the rotary receiver (19) after having passed through the twist balancing means (18) which, for example, consist of a straightener and/or of a twister-straightener.

It will be recalled here that, as is well known to those skilled in the art, in order to manufacture a cord of the type having cylindrical layers (different pitches $p_2$ and $p_3$ and/or different directions of twisting of the layers C2 and C3), use is made of a device comprising two rotary (feed or receiver) members rather than just one as described hereinabove (FIG. 3) by way of example.

Figure 2:
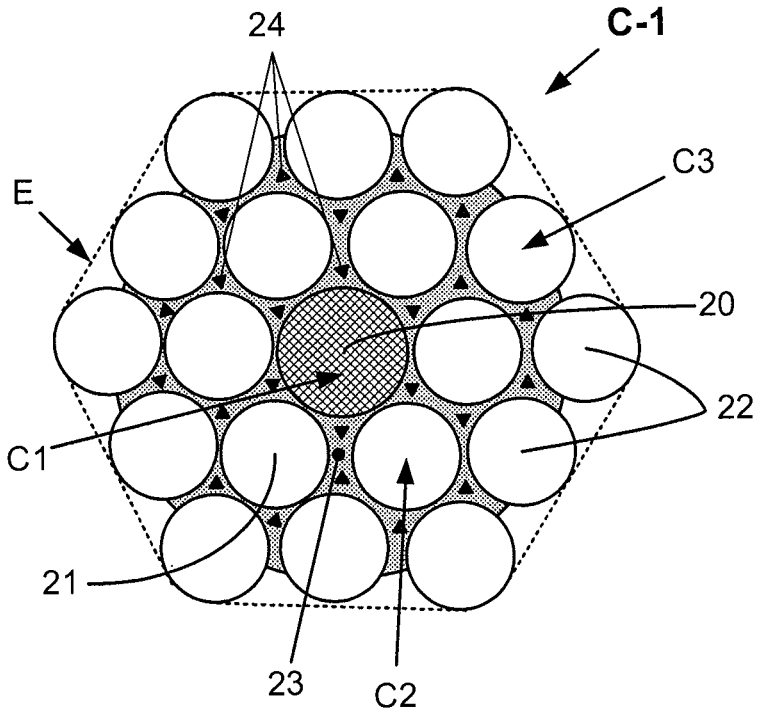
FIG. 2 shows, in cross section, an example of a cord of 1+6+12 construction of the compact type, rubberized in situ, which can be manufactured by the method of the invention.

FIG. 2 schematically shows, in section perpendicular to the axis of the cord (which is assumed to be straight and at rest), one example of a preferred 1+6+12 cord rubberized in situ, which can be obtained using the abovementioned method according to the invention.

This cord (denoted C-1) is of the compact type, that is to say that its second and third layers (C2 and C3 respectively) are wound in the same direction (S/S or Z/Z to use the recognized terminology) and also at the same pitch ($p_2=p_3$). This type of construction means that the wires (21, 22) of these second and third layers (C2, C3) form, around the core (20) or first layer (C1), two substantially concentric layers each of which has a contour (E) (depicted in dotted line) which is substantially polygonal (more specifically hexagonal) rather than cylindrical as is the case of cords with so-called cylindrical layers.

This cord C-1 can be termed an in-situ rubberized cord: each of the capillaries or gaps (empty spaces in the absence of filling rubber) formed by the adjacent wires, considered in threes, of its three layers C1, C2 and C3 is filled, at least in part (continuously or discontinuously along the axis of the cord) with the filling rubber so that over 2 cm length of cord, each capillary comprises at least one plug of rubber.

More specifically, the filling rubber (23) fills each capillary (24) (symbolized by a triangle) formed by the adjacent wires (considered in threes) of the various layers (C1, C2, C3) of the cord, very slightly moving these apart. It may be seen that these capillaries or gaps are naturally formed either by the core wire (20) and the wires (21) of the second layer (C2) that surround it, or by two wires (21) of the second layer (C2) and one wire (23) of the third layer (C3) which is immediately adjacent to them, or alternatively still, by each wire (21) of the second layer (C2) and the two wires (22) of the third layer (C3) which are immediately adjacent to it; thus, in total, there are 24 capillaries or gaps (24) present in this 1+6+12 cord.

According to a preferred embodiment, in this cord M+N+P, the filling rubber extends continuously around the second layer (C2) which it covers.

Prepared in this way, the M+N+P cord may be termed airtight: in the air permeability test described at paragraph II-1-B below, it is characterized by a mean air flow rate which is preferably less than 2 $cm^3$/min, more preferably less than or at most equal to 0.2 $cm^3$/min.

Figure 3:
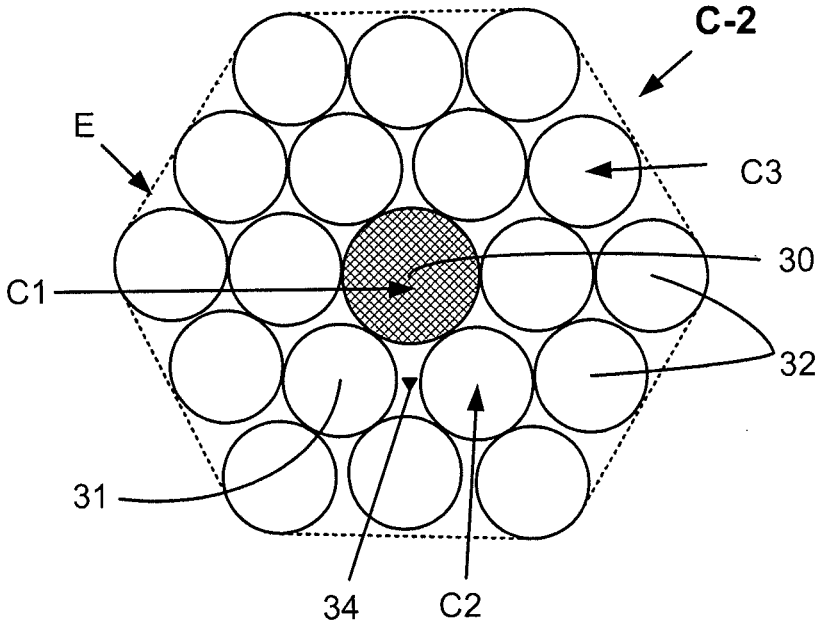
FIG. 3 shows, in cross section, a conventional cord of 1+6+12 construction, likewise of the compact type and not rubberized in situ.

For comparison, FIG. 3 provides a reminder, in cross section, of a conventional 1+6+12 cord (denoted C-2) (i.e. one that is not rubberized in situ), likewise of the compact type. The absence of filling rubber means that practically all the wires (30, 31, 32) are in contact with one another, leading to a structure that is particularly compact, although very difficult (if not to say impossible) for rubber to penetrate from the outside. The feature of this type of cord is that the various wires in threes form channels or capillaries (34), a large number of which remain closed and empty and therefore liable, through a "wicking" effect, to allow corrosive media such as water to propagate.

II. EMBODIMENTS OF THE INVENTION

The following tests demonstrate the ability of the invention to produce multi-layer cords which, by comparison with the in-situ rubberized multi-layer cords of the prior art using a conventional (not hot melt) diene rubber, have the appreciable advantage of containing a smaller and controlled quantity of filling rubber, guaranteeing them better compactness, this rubber also preferably being distributed uniformly within the cord, particularly within each of its capillaries, thus giving them optimal longitudinal impermeability; furthermore, this filling rubber has the essential advantage of having no unwanted tackiness in the raw (i.e. uncrosslinked) state.

II-1. Measurements and Tests Used

II-1-A. Dynamometric Measurements

As regards the metal wires and cords, measurements of the breaking strength denoted Fm (maximum load in N), tensile breaking strength denoted Rm (in MPa) and elongation at break denoted At (total elongation in %) are carried out in tension in accordance with Standard ISO 6892 of 1984.

As regards the diene rubber compositions, the modulus measurements are carried out under tension, unless otherwise indicated, in accordance with Standard ASTM D 412 of 1998 (test specimen "C"): the "true" secant modulus (i.e. the modulus with respect to the actual cross section of the test specimen) at 10% elongation, denoted E10 and expressed in MPa, is measured on second elongation (that is to say after one accommodation cycle) (normal temperature and moisture conditions in accordance with Standard ASTM D 1349 of 1999).

II-1-B. Air Permeability Test

This test enables the longitudinal air permeability of the tested cords to be determined by measuring the volume of air passing through a test specimen under constant pressure over a given time. The principle of such a test, well known to those skilled in the art, is to demonstrate the effectiveness of the treatment of a cord in order to make it impermeable to air. It has been described, for example, in Standard ASTM D2692-98.

The test is carried out here either on cords extracted from tires or from the rubber plies that they reinforce, which have therefore already been coated from the outside with rubber in the cured state, or on as-manufactured cords.

In the latter instance, the as-manufactured cords have first of all to be embedded, coated from the outside with a rubber known as a coating rubber. To do this, a series of 10 cords arranged parallel to one another (with an inter-cord distance of 20 mm) is placed between two skims (two rectangles measuring 80×200 mm) of an uncured diene rubber composition, each skim having a thickness of 3.5 mm; the whole assembly is then clamped in a mould, each of the cords being kept under sufficient tension (for example 2 daN) to ensure that it remains straight while it is being placed in the mould, using clamping modules; the vulcanizing (curing) process then takes place over 40 minutes at a temperature of 140° C. and under a pressure of 15 bar (rectangular piston measuring 80×200 mm). After that, the assembly is demoulded and cut up into 10 specimens of cords thus coated, in the form of parallelepipeds measuring 7×7×20 mm, for characterization.

A conventional tire rubber composition is used as coating rubber, the said composition being based on natural (peptized) rubber and N330 carbon black (65 phr), also containing the following usual additives: sulphur (7 phr), sulphenamide accelerator (1 phr), ZnO (8 phr), stearic acid (0.7 phr), antioxidant (1.5 phr) and cobalt naphthenate (1.5 phr); the modulus E10 of the coating rubber is about 10 MPa.

The test is carried out on 2 cm lengths of cord, hence coated with its surrounding rubber composition (or coating rubber) in the cured state, as follows: air at a pressure of 1 bar is injected into the inlet of the cord and the volume of air leaving it is measured using a flow meter (calibrated for example from 0 to 500 $cm^3$/min). During measurement, the cord specimen is immobilized in a compressed airtight seal (for example a dense foam or rubber seal) so that only the quantity of air passing through the cord from one end to the other along its longitudinal axis is measured; the airtightness of the airtight seal is checked beforehand using a solid rubber test specimen, i.e. one containing no cord.

The higher the longitudinal impermeability of the cord, the lower the measured flow rate. Since the measurement is accurate to within ±0.2 $cm^3$/min, measured values equal to or lower than 0.2 $cm^3$/min are considered to be zero; they correspond to a cord that can be termed airtight along its axis (i.e. in its longitudinal direction).

II-1-C. Filling Rubber Content

The amount of filling rubber is measured by measuring the difference between the weight of the initial cord (therefore the in-situ rubberized cord) and the weight of the cord (therefore that of its wires) from which the filling rubber has been removed by treatment in an appropriate extraction solvent.

The procedure is, for example, as follows. A specimen of cord of given length (for example one meter), coiled on itself to reduce its size, is placed in a fluidtight bottle containing one liter of toluene. The bottle is then agitated (125 outward/return movements per minute) for 24 hours at room temperature (20° C.) using a "shaker" (Fischer Scientific "Ping Pong 400"); after the solvent has been eliminated, the operation is repeated once. The cord thus treated is recovered and the residual solvent evaporated under vacuum for 1 hour at 60° C. The cord thus rid of its filling rubber is then weighed. From this, calculation can be used to deduce the filling rubber content of the cord, expressed in mg (milligrams) of filling rubber per g (gram) of initial cord, and averaged over 10 measurements (i.e. over 10 meters of cord in total).

II-2. Manufacture of the Cords, and Tests

In the following tests, layered cords of 1+6+12 construction, made up of fine, brass-coated carbon steel wires, are manufactured.

The carbon steel wires are prepared in a known manner, for example from machine wire s (diameter 5 to 6 mm) which are first of all work-hardened, by rolling and/or drawing, down to an intermediate diameter of around 1 mm. The steel used is a known carbon steel (USA Standard AISI 1069) with a carbon content of 0.70%. The wires of intermediate diameter undergo a degreasing and/or pickling treatment prior to their subsequent conversion. After a brass coating has been applied to these intermediate wires, what is called a "final" work-hardening operation is carried out on each wire (i.e. after the final patenting heat treatment) by cold-drawing in a wet medium with a drawing lubricant for example in the form of an aqueous emulsion or dispersion. The brass coating surrounding the wires has a very small thickness, markedly lower than one micron, for example of the order of 0.15 to 0.30 μm, which is negligible by comparison with the diameter of the steel wires.

The steel wires thus drawn have the following diameters and mechanical properties:

TABLE 1

| Steel | Ø (mm) | Fm (N) | Rm (MPa) |
|---|---|---|---|
| NT | 0.18 | 68 | 2820 |
| NT | 0.20 | 82 | 2620 |

These wires are then assembled in the form of 1+6+12 layered cords, the construction of which is as shown in FIG. 1 and the mechanical properties of which are given in Table 2.

TABLE 2

| Cord | $p_2$ (mm) | $p_3$ (mm) | Fm (daN) | Rm (MPa) | At (%) |
|---|---|---|---|---|---|
| C-1 | 10 | 10 | 120 | 2550 | 2.4 |

The 1+6+12 cords according to the invention (C-1), as depicted schematically in FIG. 1, are therefore formed of 19 wires in total, a core wire of diameter 0.20 mm and 18 wires around, all of diameter 0.18 mm, which have been wound in two concentric layers with the same pitch ($p_2$=$p_3$=10.0 mm) and in the same direction of twisting (S/S) to obtain a cord of compact type. The filling rubber content, measured using the method indicated above at paragraph I-3, is about 18 mg per g of cord. This filling rubber is present in each of the 24 capillaries or gaps formed by the various wires considered in threes, i.e. it completely or at least partially fills each of these capillaries such that, over any 2 cm length of cord, there is at least one plug of rubber in each capillary or gap.

To manufacture these cords, use was made of a device as described hereinabove and schematically depicted in FIG. 1, sheathing the core strand (1+6) then, by twisting, assembling the outer layer of 12 wires on the sheathed core strand. The core strand was thus covered with a layer of TPS elastomer around 15 μm thick. The filling rubber consisted of an unsaturated TPS elastomer extruded at a temperature of around 180° C. using a twin-screw extruder (length 960 mm, L/D=40) feeding a sizing die of diameter 0.570 mm via a pump; the core strand (1+6) was, while it was being sheathed, moving at right angles to the direction of extrusion and in a straight line.

Three unsaturated TPS elastomers (commercially available products) were tested during these test: an SBS (stirene-butadiene-stirene) block copolymer, an SIS (stirene-isoprene-stirene) block copolymer, and an S(SB)S block copolymer (blocks of stirene-butadiene-stirene in which the central polydiene block (denoted SB) was a statistical stirene-butadiene diene copolymer) with a Shore A hardness of around 70, 25 and 90 respectively.

The cords C-1 thus manufactured were then subjected to the air permeability test described at paragraph II-1, measuring the volume of air (in $cm^3$) passing through the cords in 1 minute (average over 10 measurements for each cord tested).

For each cord C-1 tested and for 100% of the measurements (i.e. ten test specimens out of ten), whatever the unsaturated TPS elastomer tested, a flow rate of zero or less than 0.2 $cm^3$/min was measured; in other words, the cords prepared according to the method of the invention can be termed airtight along their longitudinal axis.

Furthermore, control cords rubberized in situ and of the same construction as the above cords C-1 but rubberized in situ with a conventional diene rubber composition (based on natural rubber) were prepared in accordance with the method described in the aforementioned application WO 2005/071557, in several discontinuous steps, sheathing the intermediate 1+6 core strand using an extrusion head and then, in a second stage, cabling the remaining 12 wires around the core strand thus sheathed, to form the outer layer. These control cords were then subjected to the air permeability test of paragraph I-2.

It was noted first of all that none of these control cords gave 100% (i.e. ten test specimens out of ten) measured flow rates of zero or less than 0.2 $cm^3$/min, or in other words that none of these control cords could be termed airtight (completely airtight) along its axis. It was also found that, of these control cords, those which exhibited the best impermeability results (i.e. a mean flow rate of around 2 $cm^3$/min) all had relatively large amounts of unwanted filling rubber (diene rubber) overspilling from their periphery, making them ill-suited to a satisfactory calendering operation under industrial conditions, because of the problem of raw tack mentioned in the introduction to this text.

In conclusion, the cords prepared according to the method according to the invention therefore exhibit an optimal degree of penetration by the unsaturated thermoplastic elastomer, with a controlled amount of filling rubber, guaranteeing that internal partitions (which are continuous or discontinuous along the axis of the cord) or plugs of rubber in the capillaries or gaps will be present in sufficient number; thus, the cord becomes impervious to the spread, along the cord, of any corrosive fluid such as water or the oxygen in the air, thus eliminating the wicking effect described in the introduction to this text. Further, the thermoplastic elastomer used presents no problems of unwanted tackiness in the event of a slight overspill on the outside of the cord after it has been manufactured by virtue of its unsaturated nature which therefore makes it (co)vulcanizable with a matrix of unsaturated diene rubber such as natural rubber.

Of course, the invention is not restricted to the embodiments described hereinabove.

Thus, for example, the core (C1) of the cords could be made up of a wire of non-circular cross section, for example one that has been plastically deformed, notably a wire of substantially oval or polygonal, for example triangular, square or even rectangular, cross section; the core could also be made up of a preformed wire, of circular cross section or otherwise, for example a wire that is wavy, twisted or contorted into the shape of a helix or a zigzag. In such cases, it must of course be appreciated that the diameter $d_c$ of the core (C1) represents the diameter of the imaginary cylinder of revolution surrounding the central wire (the envelope diameter) rather than the diameter (or any other transverse dimension if its cross section is non-circular) of the central wire itself.

For reasons of industrial feasibility, cost and overall performance, it is, however, preferable for the invention to be implemented with a single central wire (layer C1) that is conventional, linear and of circular cross section.

Further, because the central wire is less stressed during the manufacture of the cord than are the other wires, given its position in the cord, it is not necessary for this wire to be made using, for example, steel compositions that are of a high torsion ductility; advantageously, use may be made of any type of steel, for example a stainless steel.

Furthermore, one (at least one) linear wire of one of the other two layers (C2 and/or C3) could likewise be replaced by a preformed or deformed wire or, more generally, by a wire of a cross section different from that of the other wires of diameter $d_2$ and/or $d_3$, so as, for example, to further improve the penetrability of the cord by the rubber or any other material, it being possible for the envelope diameter of this replacement wire to be less than, equal to or greater than the diameter ($d_2$ and/or $d_3$) of the other wires that make up the relevant layer (C2 and/or C3).

Without altering the spirit of the invention, some of the wires that make up the cord according to the invention could be replaced by wires other than steel wires, metallic or otherwise, and could notably be wires or threads made of an inorganic or organic material of high mechanical strength, for example monofilaments made of liquid crystal organic polymers.

The invention claimed is:

1. A method of manufacturing a multi-layer metal cord having a plurality of concentric layers of wires, comprising one or more inner layer(s) and an outer layer, rubberized in situ, with rubber or a rubber composition, the method comprising the following steps:

at least one step of sheathing at least one inner layer with the rubber or the rubber composition by passing through at least one extrusion head; and an assembling step in which the wires of the outer layer are assembled around the inner layer adjacent to it, in order to form the multi-layer cord thus rubberized from the inside, wherein the rubber is an unsaturated thermoplastic elastomer extruded in the molten state.

2. The method according to claim 1, wherein the unsaturated thermoplastic elastomer is a thermoplastic styrene elastomer.

3. The method according to claim 2, wherein the unsaturated thermoplastic styrene elastomer comprises polystyrene blocks and polydiene blocks.

4. The method according to claim 3, wherein the polydiene blocks are selected from the group consisting of polyisoprene blocks, polybutadiene blocks and mixtures of such blocks.

5. The method according to claim 4, wherein the thermoplastic styrene elastomer is a copolymer selected from the group consisting of styrene/butadiene/styrene (SBS), styrene/butadiene/butylene/styrene (SBBS), styrene/isoprene/styrene (SIS) and styrene/butadiene/isoprene/styrene (SBIS) block copolymers and blends of these copolymers.

6. The method according to claim 1, wherein the cord comprises a single inner layer.

7. The method according to claim 1, wherein the cord comprises a plurality of inner layers.

8. The method according to claim 7, wherein sheathing is performed on the innermost layer or core of the cord.

9. The method according to claim 7, wherein sheathing is performed on each inner layer of the cord.

10. The method according to claim 1, wherein at least one inner layer contains more than one wire and in which the wires of the outer layer are wound as a helix with the same pitch and in the same direction of winding as the wires of each inner layer containing more than one wire.

* * * * *